US008749440B2

(12) United States Patent
Oh

(10) Patent No.: US 8,749,440 B2
(45) Date of Patent: Jun. 10, 2014

(54) ANTENNA AND MOBILE TERMINAL INCLUDING THE SAME

(75) Inventor: SangBae Oh, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 190 days.

(21) Appl. No.: 13/292,911

(22) Filed: Nov. 9, 2011

(65) Prior Publication Data

US 2013/0033403 A1 Feb. 7, 2013

(30) Foreign Application Priority Data

Aug. 2, 2011 (KR) ..... 10-2011-0077069

(51) Int. Cl.
*H01Q 11/12* (2006.01)

(52) U.S. Cl.
USPC ..... 343/741

(58) Field of Classification Search
USPC ..... 343/741
See application file for complete search history.

(56) References Cited

U.S. PATENT DOCUMENTS

| | | | | |
|---|---|---|---|---|
| 5,337,063 | A * | 8/1994 | Takahira | 343/741 |
| 2002/0163474 | A1 * | 11/2002 | Ieda et al. | 343/742 |
| 2009/0079268 | A1 * | 3/2009 | Cook et al. | 307/104 |

FOREIGN PATENT DOCUMENTS

| | | | |
|---|---|---|---|
| JP | 11-122146 | A | 4/1999 |
| JP | 2009-055302 | A | 3/2009 |
| WO | WO 2010/066799 | A2 | 6/2010 |

* cited by examiner

*Primary Examiner* — Jerome Jackson, Jr.
*Assistant Examiner* — Andrea Lindgren Baltzell
(74) *Attorney, Agent, or Firm* — Birch, Stewart, Kolasch & Birch, LLP

(57) ABSTRACT

Provided are an antenna and a mobile terminal including the antenna. The antenna includes a loop antenna, a solenoid, and a plurality of connections. The loop antenna is installed on a mobile terminal. The solenoid is connected in parallel to the loop antenna, and receives power. The connections connect the loop antenna to the solenoid. Accordingly, the degree of freedom of an antenna shape and a recognition distance of the antenna are improved.

4 Claims, 3 Drawing Sheets

ANTENNA AND MOBILE TERMINAL INCLUDING THE SAME

CROSS-REFERENCE TO RELATED APPLICATIONS

The present application claims the benefit of priority under 35 U.S.C. 119 to Korean Patent Application No. 10-2011-0077069 filed on Aug. 2, 2011 which is hereby incorporated by reference in its entirety.

BACKGROUND

The present disclosure relates to an antenna and a mobile terminal including the same, and more particularly, to an antenna including a solenoid disposed inside a square pattern to receive power, thereby improving a magnetic field and the degree of freedom of an antenna shape.

As mobile terminals are developed, they have various functions such as voice calls, video calls, capturing of a moving image, playing of a file and a game, and receiving of broadcasting. Accordingly, mobile terminals are complicated and miniaturized.

Such a mobile terminal is provided not only with an antenna for voice or video calls, but also with a device such as Wi-Fi, Bluetooth, or a near field communication (NFC) antenna to receive and transmit signals of different frequency bands.

FIG. 1 is a cut-away perspective view illustrating an inner structure of a mobile terminal including an NFC antenna installed on a battery pack of the mobile terminal. Referring to FIG. 1, a mobile terminal 5 includes an NFC antenna 5-2, which a square type one, and is used for communications at a frequency of about 13.56 Mhz. Noises transferred by the mobile terminal 5, and eddy currents induced in a conductor decrease an NFC recognition distance. Ferrite sheets may be used to address this issue. A ferrite sheet 5-1 may be disposed between the NFC antenna 5-2 and an outer surface (not shown) of a battery cell.

Parallel-fed double loop antennas may be used to ensure a stable recognition distance for improving a magnetic field. NFC antennas may be square type antennas to vary in shape and size, so that an antenna for a voice and video call, or a GPS or Wi-Fi antenna can transmit and receive signals of a different frequency band, without interference with an NFC antenna.

SUMMARY

In one embodiment, an antenna includes: a loop antenna installed on a mobile terminal; a solenoid connected in parallel to the loop antenna, and receiving power; and a plurality of connections connecting the loop antenna to the solenoid.

The details of one or more embodiments are set forth in the accompanying drawings and the description below. Other features will be apparent from the description and drawings, and from the claims.

DETAILED DESCRIPTION OF THE EMBODIMENTS

Figure 1:
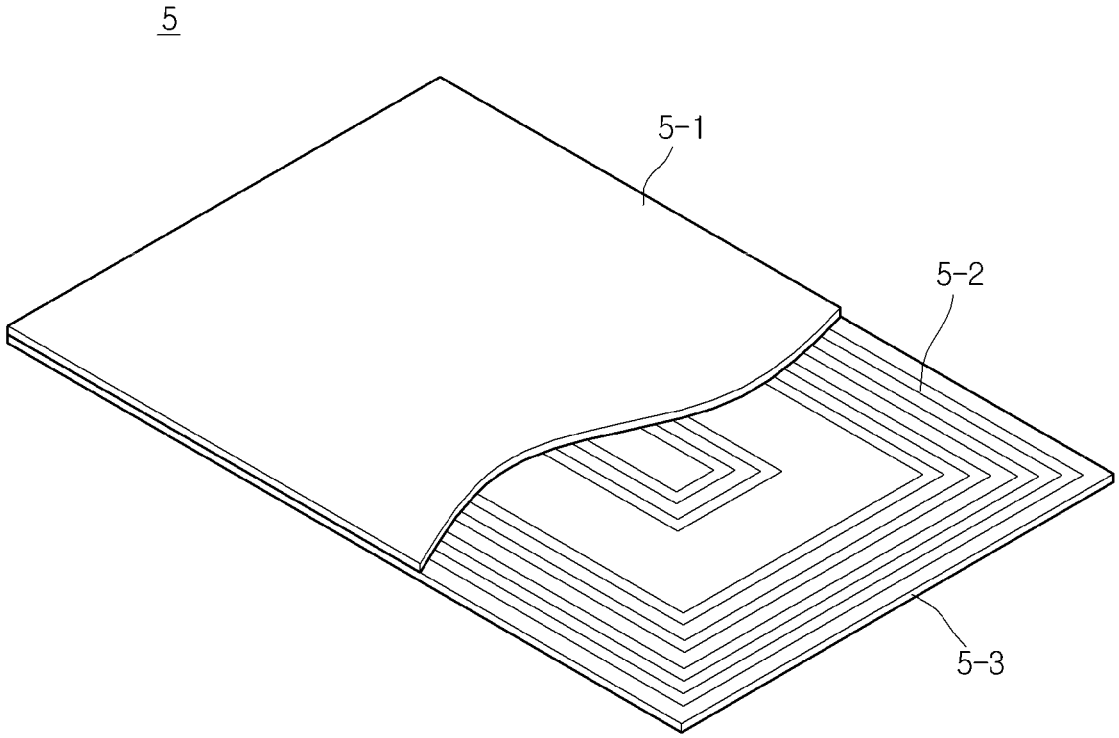
FIG. 1 is a cut-away perspective view illustrating an inner structure of a mobile terminal including an NFC antenna installed on a battery pack of the mobile terminal.

In the description of embodiments, it will be understood that when a layer (or film), region, pattern or structure is referred to as being 'on/over' or 'under' another layer (or film), region, pattern or structure, the terminology of 'on/over' and 'under' includes both the meanings of 'directly' and 'indirectly'. Further, the reference about 'on/over' and 'under' each layer will be made on the basis of drawings.

In the drawings, the thickness or size of each layer is exaggerated, omitted, or schematically illustrated for convenience in description and clarity. Also, the size of each element does not entirely reflect an actual size.

Reference will now be made in detail to the embodiments of the present disclosure, examples of which are illustrated in the accompanying drawings.

Figure 2:
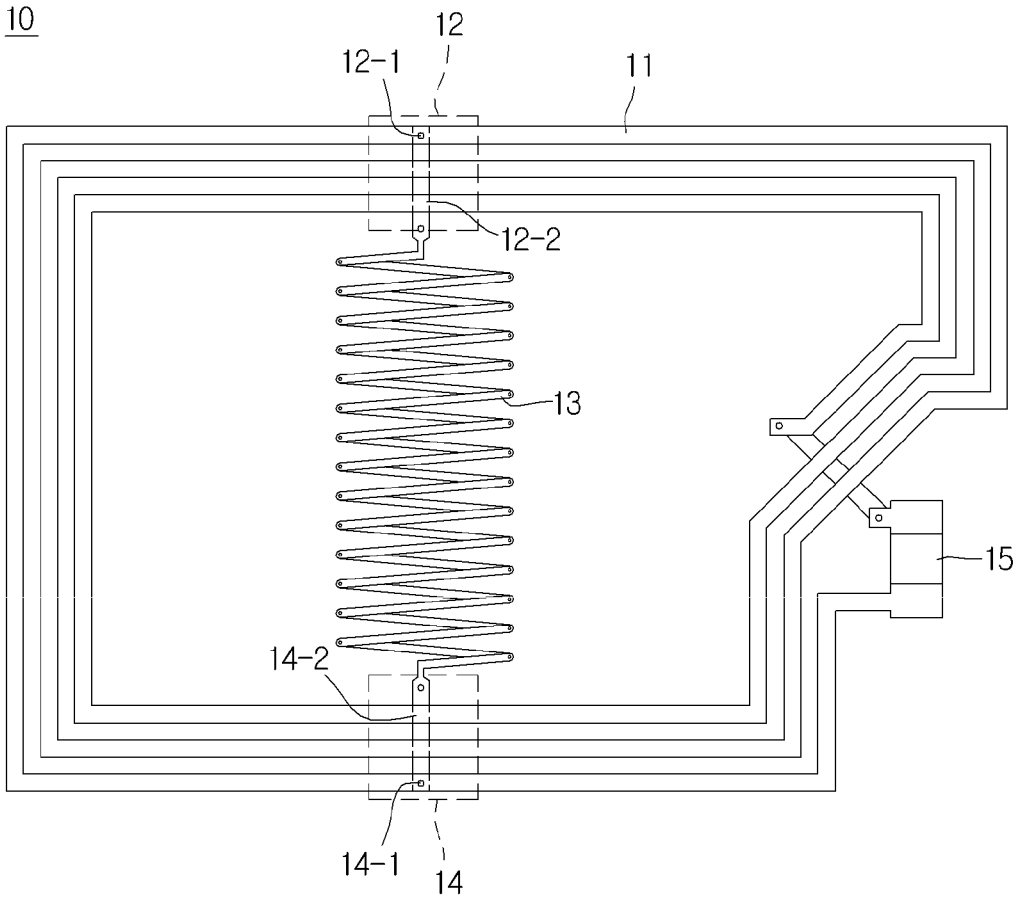
FIG. 2 is a plan view illustrating an antenna according to an embodiment.

FIG. 2 is a plan view illustrating an antenna according to an embodiment. Referring to FIG. 2, an antenna 10 according to the current embodiment may include: a loop antenna installed on a mobile terminal; a solenoid 13 connected in parallel to the loop antenna 11 and receiving power; and a connection 12 connecting the loop antenna 11 to the solenoid 13. Further, the antenna 10 may include a power source 15 providing electricity to a square pattern.

The loop antenna 11 may be constituted by at least one square pattern. In FIG. 2, the loop antenna 11 is constituted by three square patterns.

The solenoid 13 may be disposed inside of the loop antenna 11 constituted by the square patterns.

The connection 12 may connect the outermost one of the square patterns to a terminal of the solenoid 13.

The connection 12 may include contacts 12-1 and 12-2 to the square patterns to the solenoid 13. The contact 12-1 connects the outermost square pattern to one(upper) terminal of the solenoid 13. A contact 14-1 connects the outermost square pattern to the other(lower) terminal of the solenoid 13. The contacts 12-1 and 14-1 may be formed symmetrically to each other with respect to the inner center of the loop antenna 11.

The connection 12 and a connection 14 may include not only the contacts 12-1 and 14-1 disposed on the outermost pattern, but also a plurality of contacts disposed on the other patterns. The plurality of contacts may connect the square pattern to a portion of the solenoid 13. For example, the one (upper) terminal of the solenoid 13 is connected to the outermost pattern through the contact 12-1. When the outermost pattern is disposed over the one(upper) terminal of the solenoid 13 at the contact 12-1, the one(upper) terminal of the solenoid 13 may be disposed over another pattern at another contact. The innermost pattern may be disposed over the upper terminal of the solenoid 13 at the contact 12-2, like at the contact 12-1. That is, according to the current embodiment, when a terminal of a solenoid contacts a plurality of patterns, the relative positions between the terminals and the patterns may be reversed at neighboring contacts.

As described above, the contacts 12-1, 12-2, 14-1, and 14-2, connecting the terminals of the solenoid 13 to the plurality of patterns, may function as feed points for the solenoid 13, and constitute a portion of the loop antenna 11 or the a portion of solenoid 13.

Since the solenoid 13 is connected to a portion of the outermost pattern in a square shape, the antenna 10 can amplify a magnetic field. For example, when a magnetic field is formed in a direction perpendicular to a square surface, the solenoid 13 forms a magnetic field in a direction to reinforce the magnetic field formed in the perpendicular direction, thereby increasing the intensity of the electric field on the whole.

In addition, since the antenna 10 has a square shape, the shape thereof can be easily changed. Even though the antenna includes the solenoid 13, the shape thereof can be easily changed. Thus, the antenna 10 is adapted to a small device such as a mobile terminal.

Figure 3:
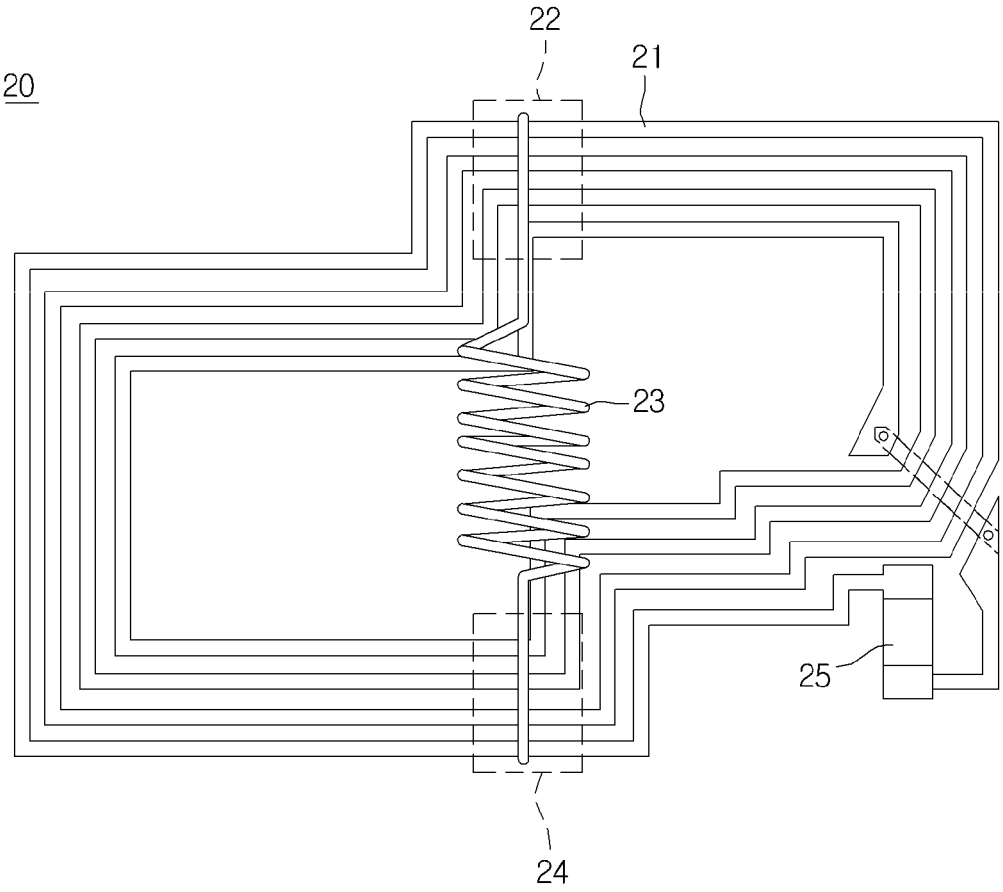
FIG. 3 is a plan view illustrating an antenna according to another embodiment.

FIG. 3 is a plan view illustrating an antenna according to another embodiment. Referring to FIG. 3, an antenna 20 according to the current embodiment may include a loop antenna 21, a solenoid 23, a connection 22, and a power source 25. The antenna 20 is the same in configuration and operation as the antenna 10 except for the shape of the loop antenna 21.

Also in FIG. 3, terminals of the solenoid 23 contact the outermost one of patterns of the loop antenna 22 in positions symmetrical to each other.

As described above, according to an embodiment, the intensity of a magnetic field can be improved without increasing the size of an antenna. In addition, the antenna can be applied to a mobile terminal.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An antenna comprising:

a loop antenna installed on a mobile terminal and comprising one or more square patterns;

a solenoid disposed inside of the square patterns, connected in parallel to the loop antenna, and receiving power; and a plurality of connections connecting the loop antenna to the solenoid, wherein the connections comprise two contacts that contact the outermost one of the square patterns to both ends of the solenoid, and wherein the contacts are symmetrical to each other with respect to an axis passing a center of the solenoid and perpendicular to another axis connecting the both ends of the solenoid.

2. The antenna according to claim 1, wherein the connections further comprise a plurality of contacts connecting a portion of the solenoid to the square pattern disposed inside of the outermost square pattern.

3. A mobile terminal comprising the antenna according to claim 1.

4. A mobile terminal comprising the antenna according to claim 1.

* * * * *